US011304468B2

(12) United States Patent
Ault et al.

(10) Patent No.: US 11,304,468 B2
(45) Date of Patent: Apr. 19, 2022

(54) HAT COMPRISING A VARIABLE CIRCUMFERENCE APERTURE

(71) Applicant: KARSTEN MANUFACTURING CORPORATION, Phoenix, AZ (US)

(72) Inventors: Aidan Ault, Bozeman, MT (US); Alex Kump, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 45 days.

(21) Appl. No.: 16/723,685

(22) Filed: Dec. 20, 2019

(65) Prior Publication Data

US 2020/0196695 A1 Jun. 25, 2020

Related U.S. Application Data

(60) Provisional application No. 62/782,892, filed on Dec. 20, 2018.

(51) Int. Cl.
*A42B 1/22* (2006.01)

(52) U.S. Cl.
CPC ..... *A42B 1/225* (2013.01)

(58) Field of Classification Search
CPC .. A42B 1/225; A42B 1/02; A42B 1/04; A42B 1/041; A42B 1/00; A42B 1/205; A42B 1/206; A42B 1/22; A42B 1/0182; A42B 1/049
USPC ..... 2/171.1, 171.5, 171.6, 195.2
See application file for complete search history.

(56) References Cited

U.S. PATENT DOCUMENTS

| | | | | | |
|---|---|---|---|---|---|
| 1,434,607 | A | * | 11/1922 | Gilson | A42B 1/041 132/274 |
| 5,321,854 | A | | 6/1994 | Kronenberger | |
| 5,799,334 | A | | 9/1998 | Griffith et al. | |
| D405,590 | S | * | 2/1999 | Bartz | D2/883 |
| 5,875,488 | A | | 3/1999 | Milani | |
| 5,933,872 | A | * | 8/1999 | Lerna | A42B 1/225 2/209.7 |
| 6,357,642 | B1 | | 3/2002 | Marchessault et al. | |
| D593,732 | S | | 6/2009 | Tilley et al. | |
| D624,286 | S | | 9/2010 | Hall | |
| D670,068 | S | | 11/2012 | Bomze | |
| D750,356 | S | * | 3/2016 | McLendon | A45D 8/40 D2/889 |
| D882,214 | S | * | 4/2020 | Yoo | A42B 1/041 D2/876 |
| 2004/0006809 | A1 | * | 1/2004 | Crenshaw | A42C 5/04 2/209.3 |
| 2004/0128739 | A1 | | 7/2004 | Tufano-Sisca | |
| 2006/0168709 | A1 | | 8/2006 | Rattay | |
| 2006/0206984 | A1 | | 9/2006 | Jaye et al. | |

(Continued)

*Primary Examiner* — Amy Vanatta

(57) ABSTRACT

A hat includes a first and second overlapping panel in the rear of the body and an elastic band. The overlapping panels each comprise an arcuate edge. When overlapped, the arcuate edges define an aperture. An elastic band attaches to the arcuate edges and transitions from the first arcuate edge to the second arcuate edge in a looping manner. When a wearer pulls her hair through the aperture, the aperture increases in size. Once the wearer's hair is pulled through the aperture, the aperture decreases in size and provides a secure fit around the wearer's hair. The elastic loop supports the long hair upwards in a manner that prevents the hat from riding up or the hair from falling onto a rear brim.

18 Claims, 8 Drawing Sheets

(56) References Cited

U.S. PATENT DOCUMENTS

| | | | | |
|---|---|---|---|---|
| 2007/0118970 | A1 | 5/2007 | Gerstel Costello | |
| 2008/0209615 | A1* | 9/2008 | Raftery | A42B 1/24 2/209.13 |
| 2009/0151047 | A1 | 6/2009 | Garza | |
| 2009/0199323 | A1* | 8/2009 | Zakarian | A45D 8/40 2/209.14 |
| 2011/0173739 | A1 | 7/2011 | Riesen et al. | |
| 2013/0025026 | A1 | 1/2013 | Smith et al. | |
| 2017/0042269 | A1 | 2/2017 | Lause | |
| 2017/0258166 | A1* | 9/2017 | Charles, Jr. | A45D 8/40 |
| 2019/0053560 | A1* | 2/2019 | Yoo | A42B 1/225 |
| 2020/0305531 | A1* | 10/2020 | Harry | A42B 1/225 |

* cited by examiner

HAT COMPRISING A VARIABLE CIRCUMFERENCE APERTURE

CROSS-REFERENCE TO RELATED APPLICATIONS

This disclosure claims the priority of U.S. Provisional Patent Appl. No. 62/782,892, filed on Dec. 20, 2018, the contents of which are incorporated fully herein by reference in its entirety.

TECHNICAL FIELD

This disclosure relates generally to hats, and more specifically to hats with a rear aperture and looping elastic band which provide wearers with long hair a more comfortable fit and better protection from the elements.

BACKGROUND

Hats, caps, and other forms of headdress (collectively "hats") generally known in the art have certain limitations. For example, a problem persists for hat wearers who have long hair. If a wearer lets her long hair drape downward when wearing a hat, the hat will cause her hair to become matted. Additionally, the elasticity of the hat's headband can cause the hat to ride up on her head and not sit properly.

Rather than let her hair drape underneath the hat, a wearer can place her hair into a ponytail. If a hat is placed over the ponytail, it will cause an imperfect fit. This imperfect fit can cause discomfort to the wearer because the hat will not sit evenly on her head.

Another alternative is to push the long hair through a fixed aperture in the rear of the hat body. This presents problems as well. If using this method on beanie-type hats, a fixed opening will allow cold air to permeate the hat. If used on a beanie-type hat having a concentric brim, the fixed opening allows the hair to fall onto the rear brim causing the hat to pull backwards on the wearer's head, creating discomfort and poor sun protection.

Many in the art have attempted to cure these problems by providing a hat with an adjustable opening in the rear. However, these attempts have functional problems. For example, if the rear aperture does not have a mechanical cinching apparatus, the hair will be collected in a loose manner and create an unsightly appearance. If the rear aperture does comprise a mechanical cinching feature, additional problems may be observed. For example, operating a cinching device on the rear of one's head may prove difficult because there is no line of sight. Additionally, if a mechanical cinching apparatus, such as a zipper or clasp, is integrated, it may catch hair leading to discomfort and or pain for the wearer. Further, these designs increase manufacturing costs and lower ornamental appeal as the mechanical cinching apparatus must be integrated late in production and will be visible on the outside of the hat. Thus, there is a need in the art to develop a hat for wearers with long hair.

Figure 1:
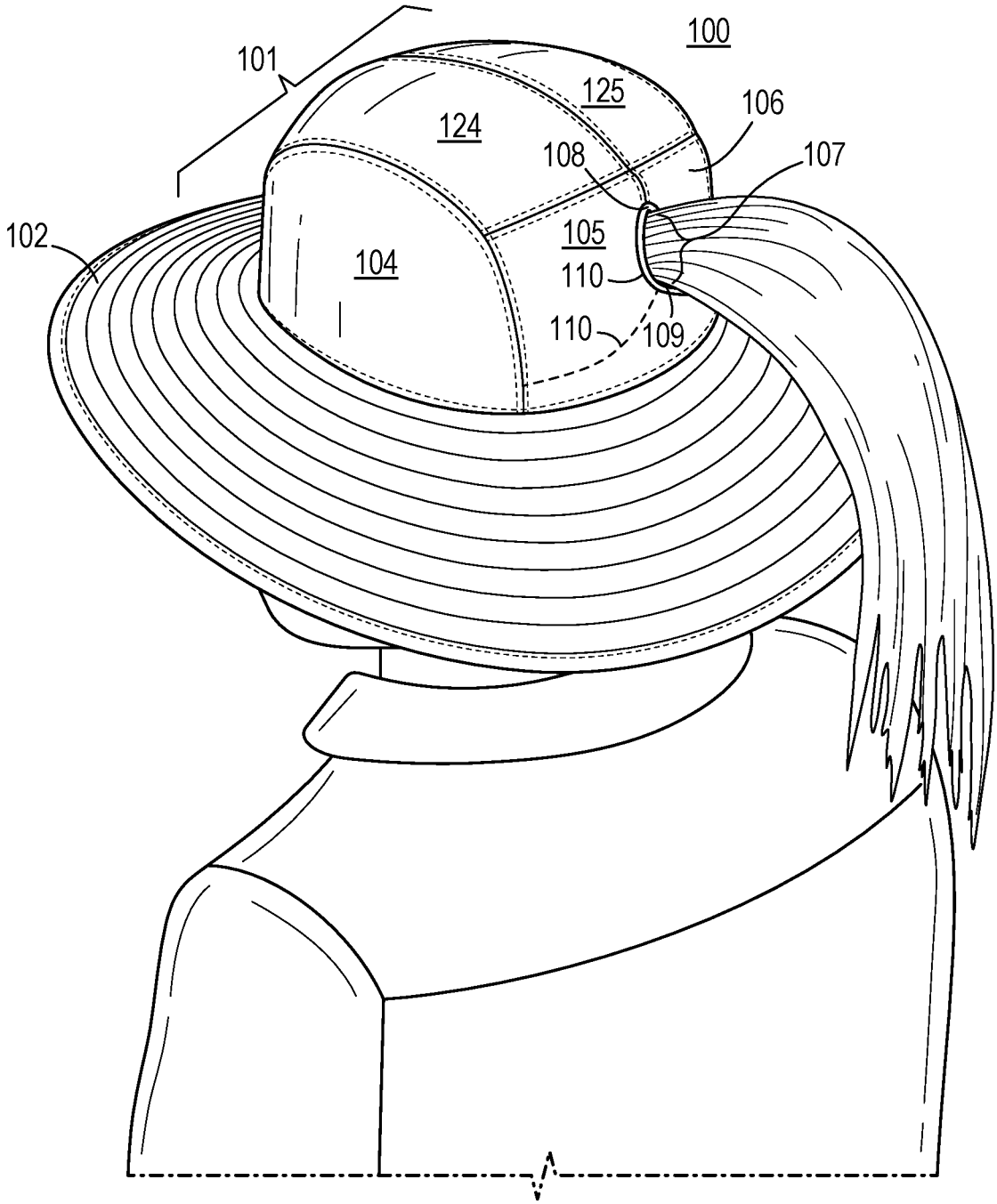
FIG. 1 illustrates a perspective view of a boonie-type hat having a varying circumference aperture.

Presented below is a hat comprising a variably-sized rear aperture defined by arcuate rear panel edges. An elastic band, that overlaps itself in a looping manner, is attached to the arcuate edges such that it exerts an elastic force on the aperture. This configuration provides wearers the ability to expand the aperture and pull a collection of hair through. After the hair is pulled through, the elastic band causes the aperture to contract around the hair. The result of this feature is a hat that fits properly on the wearer's head without the need for a mechanical cinching apparatus.

Other aspects of the disclosure will become apparent by consideration of the detailed description and accompanying drawings.

DESCRIPTION

Described herein is a piece of headgear/headdress (hereinafter "hat") for wearing on the head of the wearer. The hat comprises a back portion having a variable-sized apparatus which can contract around the wearer's hair without the need for a mechanical cinching apparatus.

The hat has a body comprising a plurality of panels. The plurality of panels can be 2, 3, 4, 5, or 6 panels that intersect with each other to collect and support the hair in a plurality of panels. The plurality of panels can define a crown having a top, a bottom, a front, and a rear portion. The rear portion can include two panels. The two rear panels can each comprise a top connection edge and an arcuate edge. The top connection edge of the first rear panel is located near the top of the crown and permanently fixed to the top connection edge of the second rear panel. The arcuate edge of the first rear panel overlaps the arcuate edge of the second rear panel in a slidable manner such that a first arcuate edge can slide over a second arcuate edge.

The overlapping arcuate edges form a shape. The top end of the shape is fixed and defined by the top edges of the rear panels. The bottom end of the shape is motile and defined by the point where the two rear panel arcuate edges overlap one another. This allows a wearer to increase or decrease the size of the aperture by manipulating the rear panels.

To control the size of the aperture, an elastic band can be attached to the arcuate edges. The elastic band is attached such that: a first portion is attached to the periphery of the first arcuate edge and a second portion is attached to the periphery of the second arcuate edge. The elastic band transitions from the first arcuate edge to the second arcuate edge in a looping manner. The looping orientation causes the elastic band to exert an elastic force on the aperture that counteracts external forces which expand the aperture.

When utilizing this hat, a wearer can use her hand to expand the aperture and pull her hair outside of the hat body through the expanded aperture. After the hair is pulled through, the elastic forces exerted by the elastic band ensure that the aperture contracts around the hair. This provides a secure and comfortable fit without the need for a cinching apparatus.

In many embodiments, hat 100, 200, 300 comprises materials generally known to persons of skill in the art of hat design. The body 101, 201, 301 can comprise materials including, but not limited to: polyester, cotton, nylon, polyester, spandex, cotton, mesh, or a blend thereof. The material of brim 102, 302 can similarly include materials generally known to persons of skill in the art of hat design; including, but not limited to: polyester, cotton, nylon, polyester, spandex, cotton, mesh, plastic, paper, or a blend thereof. The body 101, 201, 301 and brim 102, 302 can be constructed using a variety of hat construction methods generally known to persons of skill in the art of hat design, including, but not limited to: sewing, stitching, laminating, or knitting. In many embodiments, the elastic band can comprise an elastic material.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements but can include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the apparatus, methods, and/or articles of manufacture described herein are, for example, capable of operation in other orientations than those illustrated or otherwise described herein. Additionally, the term "plurality," as used herein, indicates any number greater than one, either disjunctively or conjunctively, as necessary, up to an infinite number. Nothing in this specification should be construed as requiring a specific three dimensional orientation of structures in order to fall within the scope of this invention. Also, the reader is advised that the attached drawings are not necessarily drawn to scale.

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways.

Introduction

Described below, the present description is directed to a hat having a rear aperture. The hat comprises a body. The body can comprise a plurality of panels that define a domed crown. The body panels can include, but are not limited to, a plurality of front panels, a plurality of top panels, a plurality of side panels, and/or a plurality of rear panels. The hat can further comprise a top, a bottom, a bottom edge, a front, a rear, a first side, a second side, an inside, and an outside.

At least some examples of hats according to this invention relate to hat structures, including boonie-type hats, beanie-type hats, and baseball-type hats. Such hats can include various body panel constructions and brim constructions. Example structures of the hat according to this invention will be described in detail below in conjunction with FIG. 1, which illustrates an example of a hat 100 in the form of a boonie-type hat, FIG. 6, which illustrates an example of a hat 200 in the form of a beanie-type hat, and FIG. 9, which illustrates an example of hat 300 in the form of a baseball-type hat, in accordance with at least some examples of this invention. All hats described herein comprise overlapping rear panels that define an aperture.

In some embodiments, the hat comprises a brim. The brim comprises a top, a bottom, an outward edge, and an attachment edge. The brim attachment edge can attach to the hat body adjacent a bottom edge. The brim can be substantially flat or curved. The brim can only extend around a portion of the hat, similar to a baseball cap. Or the brim can extend around the entire hat, similar to a boonie hat.

In many embodiments, the first rear panel can overlap the second rear panel in a non-fixed manner that permits the first rear panel to move in a slidable manner. The overlapping arcuate edges define an aperture. The panel-shaped aperture can be any shape. For example, the panel-shaped aperture can be: an ellipse, a circle, a teardrop, a rectangle, a square, a triangle, or any other geometric shape.

In some embodiments, the hat can further comprise a fastener or other type of fastener-like apparatus, such as a cord-lock, which can be used to modify the circumference of the aperture in a drawstring-like manner. In one exemplified embodiment, the wearer can modify or manipulate the circumference of the aperture in the following manner: the wearer can first, disengage the fastener; second, increase the tension of the elastic band by pulling the band away from the hat body thereby decreasing the circumference of the aperture; and third, re-engaging the tensioner such that the circumference of the aperture remains fixed. The fastener can be located substantially outside or inside the hat and can engage the elastic band or can be separate from the elastic band.

The various figures in this application illustrate examples of hats according to this invention. When the same reference number appears in more than one drawing, that reference number is used consistently in this specification and the drawings refer to the same or similar parts throughout.

I. Boonie-Type Hat Embodiment

Figure 2:
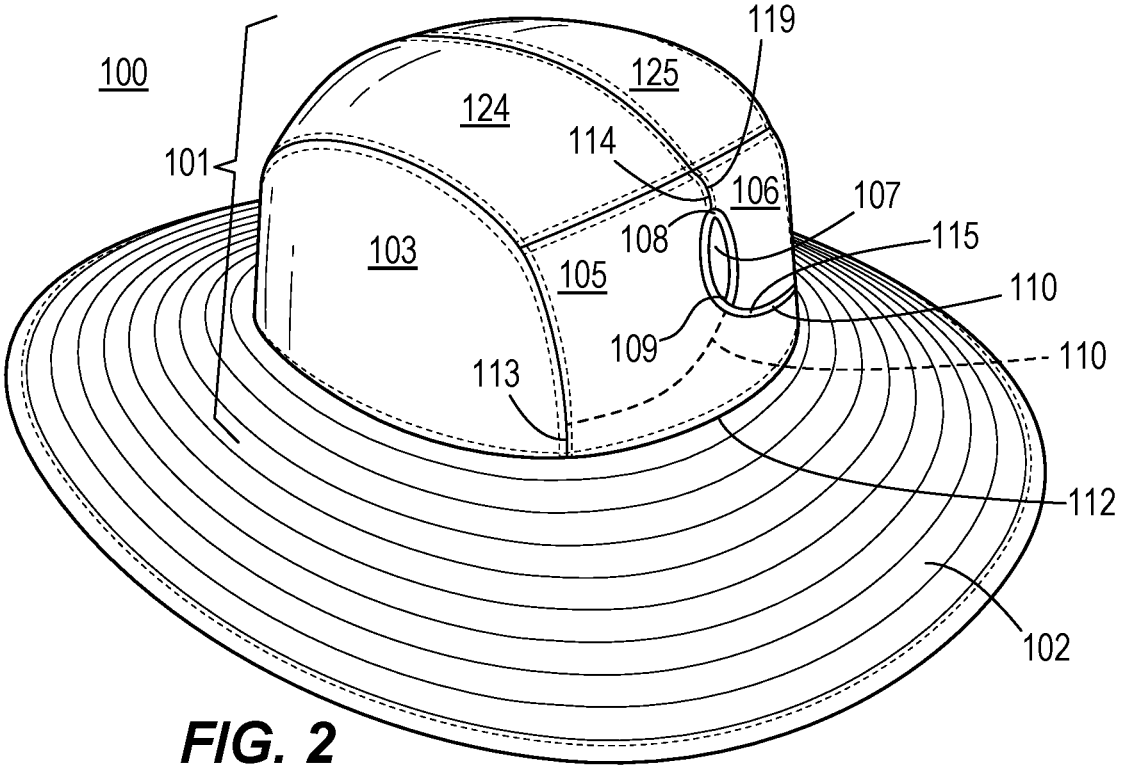
FIG. 2 illustrates a rear view of the hat of FIG. 1 showing the rear of the hat unobstructed by a wearer's hair.
Figure 3:
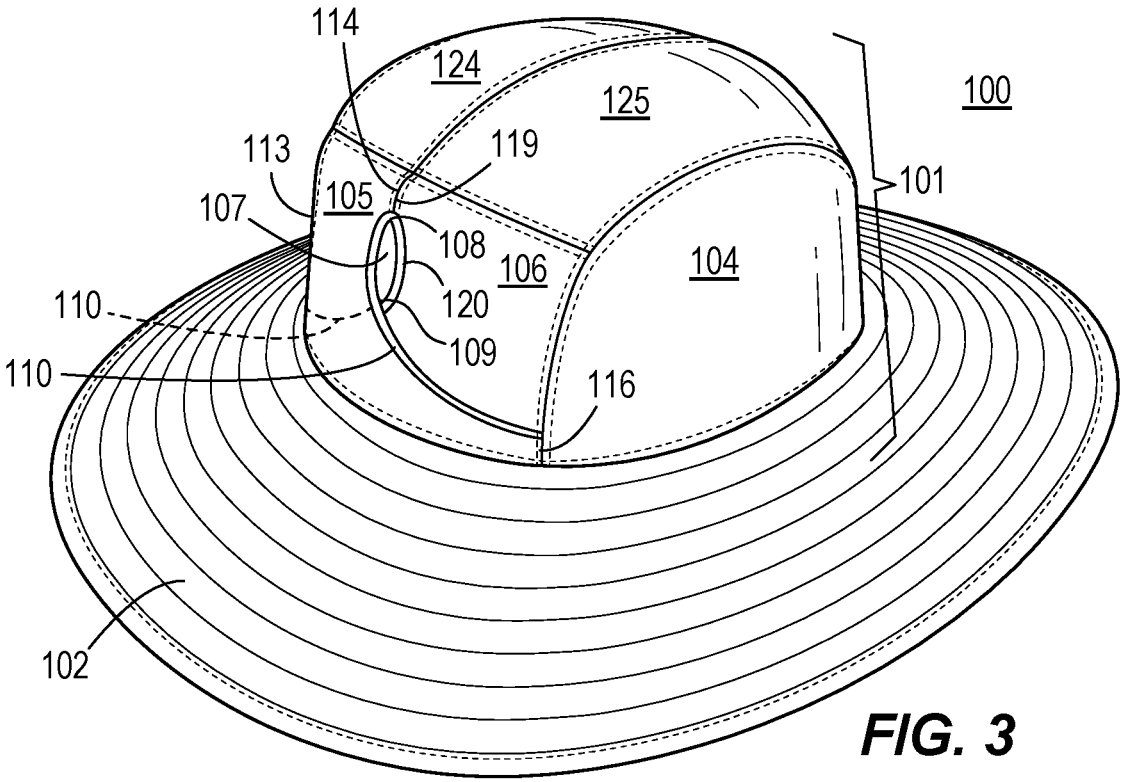
FIG. 3 illustrates another rear view of the hat of FIG. 1 showing the rear of the hat unobstructed by a wearer's hair.

FIGS. 1-5 illustrate a boonie-type hat 100. Referring to FIGS. 1-3, boonie-type hat 100 comprises a body 101 and concentric brim 102 that extends outward from the body 101. Body 101 includes a plurality of panels; such as: first side panel 104, second side panel 103, first top panel 124, second top panel 125, first rear panel 105, and second rear panel 106.

Figure 4A:
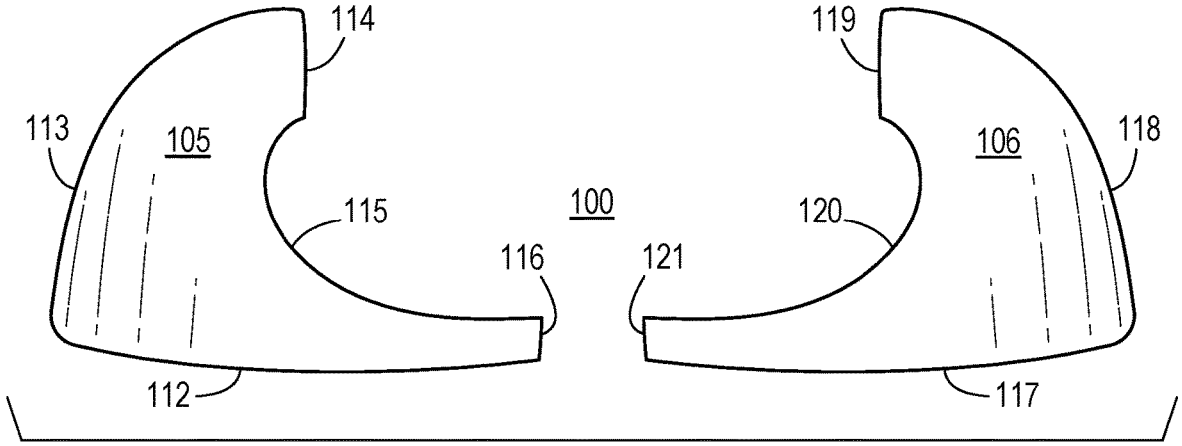
FIG. 4*a* illustrates a perspective view of the rear panel construction embodiment.
Figure 4B:
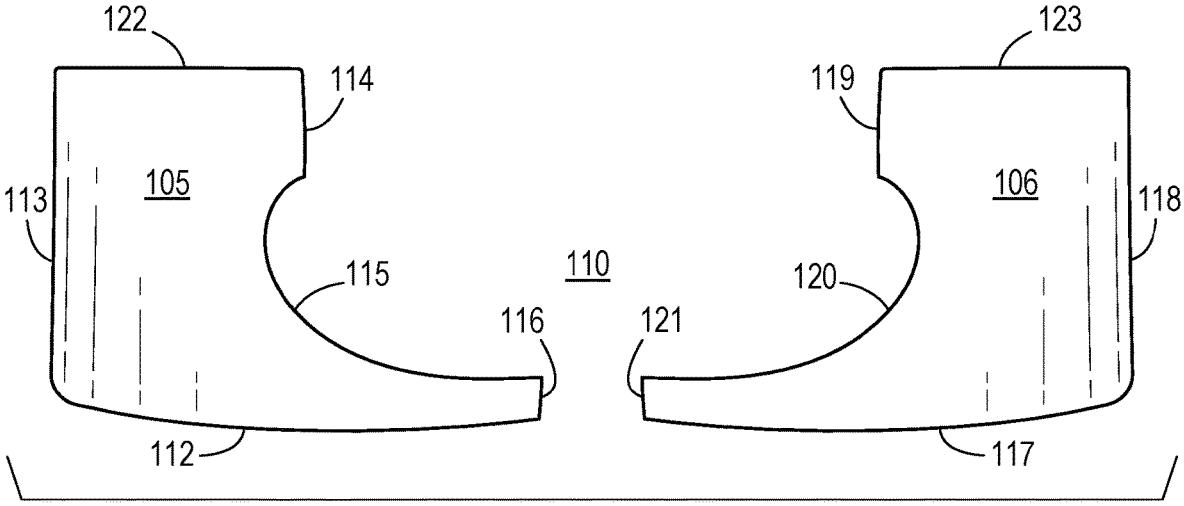
FIG. 4*b* illustrates a perspective view of the rear panel construction present in FIG. 1, FIG. 2, and FIG. 3.

Referring to FIG. 4A, first rear panel 105 can comprise first bottom edge 112, first side edge 113, first top connection edge 114, first arcuate edge 115, and first end edge 116. Second rear panel 106 can comprise second bottom edge 117, second side edge 118, second top connection edge 119, second arcuate edge 120, and second end edge 121. Bottom edges 112 and 117 can connect to brim 102. Side edges 113 and 118 can connect to adjacent side panels 103 and 104. Top connection edges 114 and 119 can connect to one another. And end edges 116 and 121 can connect to nonadjacent side panels 103 and 104. When connecting the end edges, first rear panel 105 overlaps second rear panel 106. Because the rear panels interact with one another in a slidable manner, they are able to define an aperture 107 that can be manipulated in size and shape by pulling the panels away from one another. This allows a person to pull panels 105 and 106 in opposite directions to increase a circumference of aperture 107 so that hair may be pulled through.

In alternate embodiments (not shown), second rear panel 106 can overlap first rear panel 105. Further, rear panels 105 and 106 can have a plurality of alternative connection edges. For example, referring to FIG. 4B, rear panels 105 and 106 can share the same components as FIG. 4A and further comprise top panel connection edges 122 and 123. Top panel connection edges 112 and 123 can be used to connect to rear panels 105 and 106 to adjacent top panels 124 and 125 in different body 101 configurations.

Referring back to FIGS. 1-3, the arcuate edges 115 and 120 (of first rear panel 105 and second rear panel 106) can form a shape defining an aperture 107. Aperture 107 has a top 108 and a bottom 109. Aperture top 108 is defined by the point where first arcuate edge 115 adjoins second arcuate edge 120 and is substantially adjacent top connection edges 114 and 119. Accordingly, aperture top 108 is fixed and cannot move. Aperture bottom 109 is defined by the point where the first arcuate edge 115 (of first rear panel 105) overlaps the second arcuate edge 120 (of second rear panel 106). Because of the overlapping rear panel configuration, aperture bottom 108 is motile.

Figure 5:
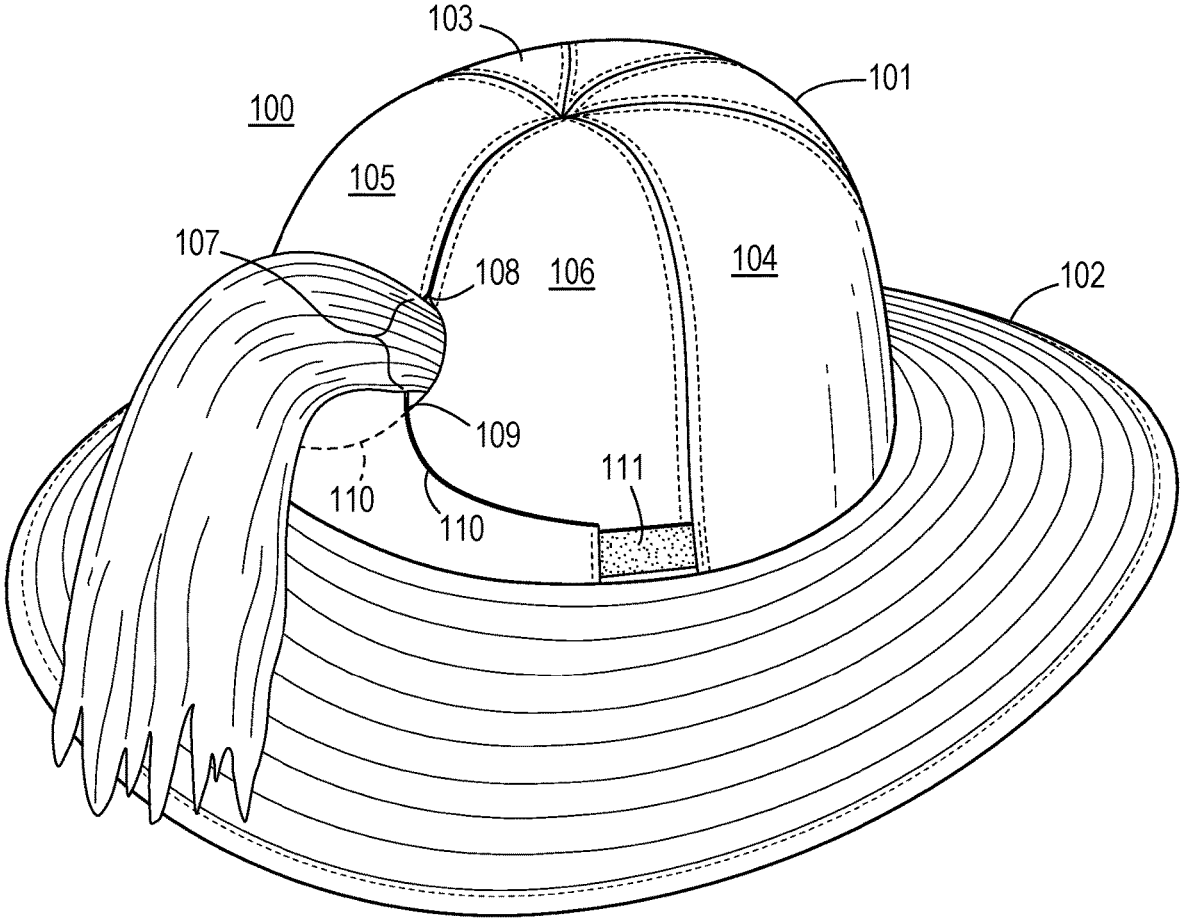
FIG. 5 illustrates a perspective view of the hat of FIG. 1 with a rear panel configuration of FIG. 4*a*.

Referring to FIG. 5, in alternative embodiments, body 101 can further comprise a first elastic connector 111 and second elastic connector 112 (not shown). Elastic connectors 111 and 112 can be used to connect end edges 116 and 121 to their nonadjacent side panels 103 and 104. For example, elastic connector 111 can have a first end that attaches to first panel end edge 116, and a second send that attaches to nonadjacent side panel 104. Elastic connectors 111 and 112 can comprise an elastic material. In this regard, the elastic connector can ensure a more-secure fit to the hat wearer while exerting additional elastic force on aperture 107. In alternative embodiments, elastic connectors 111 and 112 can comprise non-elastic properties. In these embodiments, elastic connectors 111 and 112 can comprise: Velcro, tabs, buttons, or other hat-fitting apparatuses generally known in the art.

II. Beanie-Type Hat Embodiment

Figure 6:
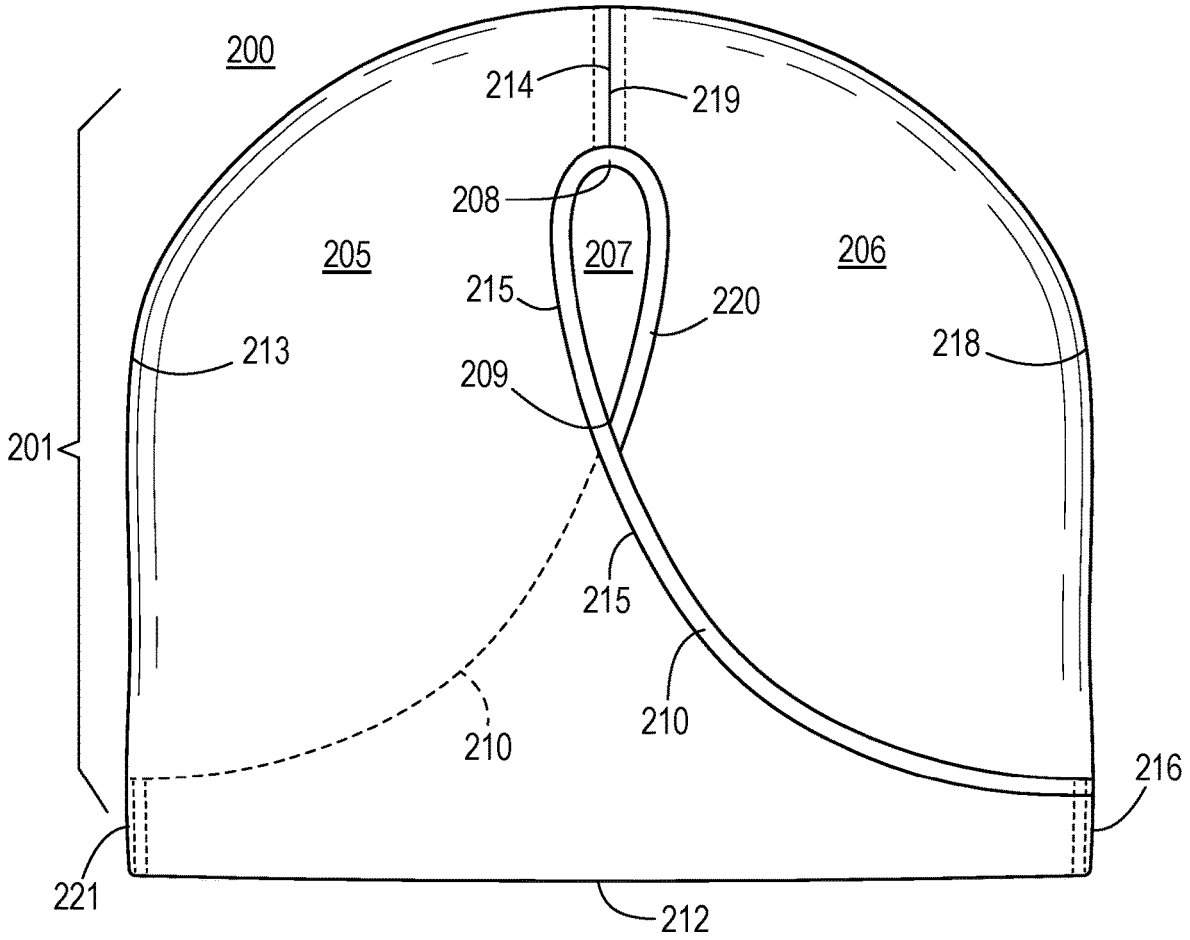
FIG. 6 illustrates a rear view of a beanie-type hat having a varying circumference aperture.
Figure 7:
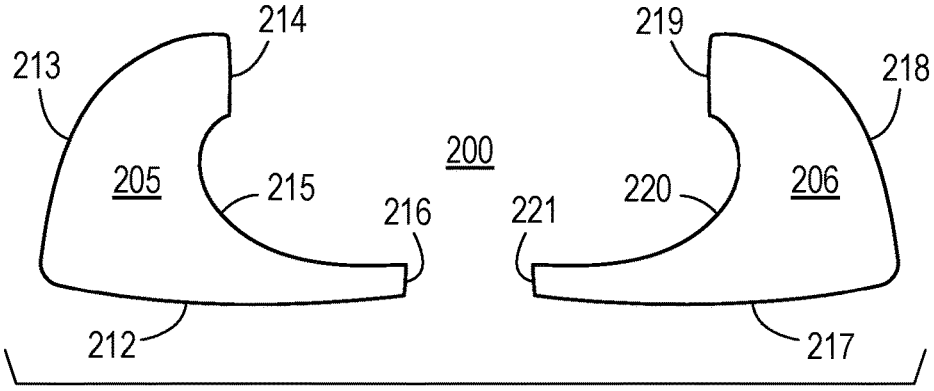
FIG. 7 illustrates the rear panels present in FIG. 6 and FIG. 8.
Figure 8:
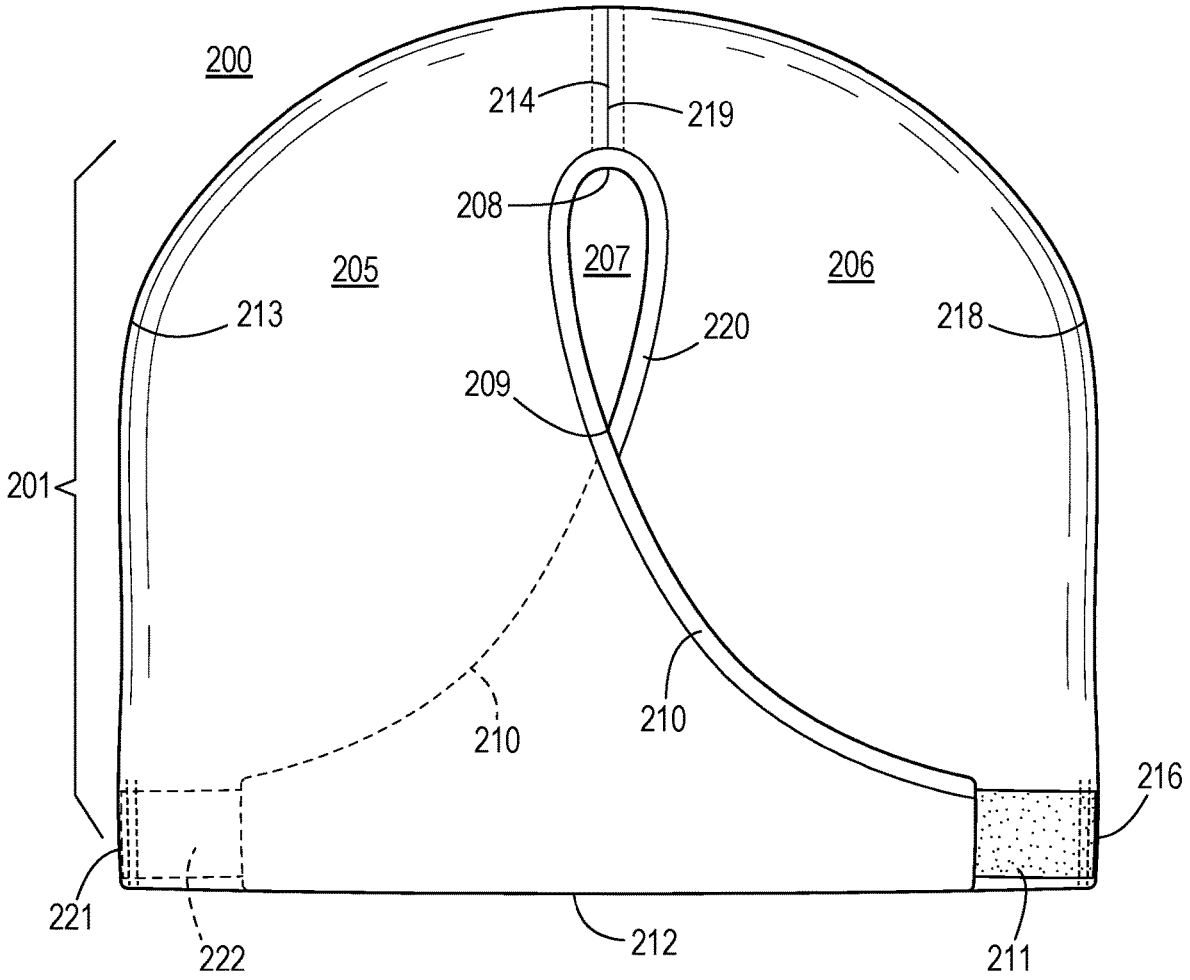
FIG. 8 illustrates a rear view of the hat of FIG. 6 with an alternative configuration.

FIGS. 6-8 illustrate a beanie-type hat 200. Beanie-type hat 200 has similar components to boonie-type hat 100, but is lacking a brim. For example, beanie-type hat 200 comprises a body 201 comprised of a plurality of panels. The body panels include, but are not limited to, a first rear panel 205 and a second rear panel 206.

Referring to FIG. 7, first rear panel 205 can comprise first bottom edge 212, first side edge 213, first top connection edge 214, first arcuate edge 215, and first end edge 216. Second rear panel 206 can comprise second bottom edge 217, second side edge 218, second top connection edge 219, second arcuate edge 220, and second end edge 221. Side edges 213 and 218 can connect to adjacent side panels 203 and 204. Top connection edges 214 and 219 can connect to one another. And end edges 216 and 221 can connect to nonadjacent side panels 203 and 204. When connecting the end edges, first rear panel 205 overlaps second rear panel 206. Because the rear panels interact with one another in a slidable manner, they are able to define an aperture 207 which may be manipulated in size and shape by pulling the panels away from one another. This allows a person to pull panels 205 and 206 in opposite directions to increase a circumference of aperture 207 so that hair may be pulled through. In alternate embodiments (not shown), second rear panel 206 can overlap first rear panel 205. Further, rear panels 205 and 206 can have a plurality of alternative connection edges.

Referring back to FIG. 6, the arcuate edges 215 and 220 (of first rear panel 205 and second rear panel 206) can form a shape defining an aperture 207. Aperture 207 has a top 208 and a bottom 209. Aperture top 208 is defined by the point where first arcuate edge 215 adjoins second arcuate edge 220 and is substantially adjacent top connection edges 214 and 219. Accordingly, aperture top 208 is fixed and cannot move. Aperture bottom 209 is defined by the point where the first arcuate edge 215 (of first rear panel 205) overlaps the second arcuate edge 220 (of second rear panel 206). Because of the overlapping rear panel configuration, aperture bottom 208 is motile.

Referring to FIG. 8, in alternative embodiments, body 201 can further comprise a first elastic connector 211 and second elastic connector 212 (not shown). Elastic connectors 211 and 212 can be used to connect end edges 216 and 221 to their nonadjacent side panels 203 and 204. For example, elastic connector 211 can have a first end that attaches to first panel end edge 216, and a second send that attaches to nonadjacent side panel 204. Elastic connectors 211 and 212 can comprise an elastic material. In this regard, the elastic connector can ensure a more-secure fit to the hat wearer while exerting additional elastic force on aperture 207. In alternative embodiments, elastic connectors 211 and 212 can comprise non-elastic properties. In these embodiments, elastic connectors 211 and 212 can comprise: Velcro, tabs, buttons, or other hat-fitting apparatuses generally known in the art.

III. Baseball-Type Hat Embodiment

Figure 9:
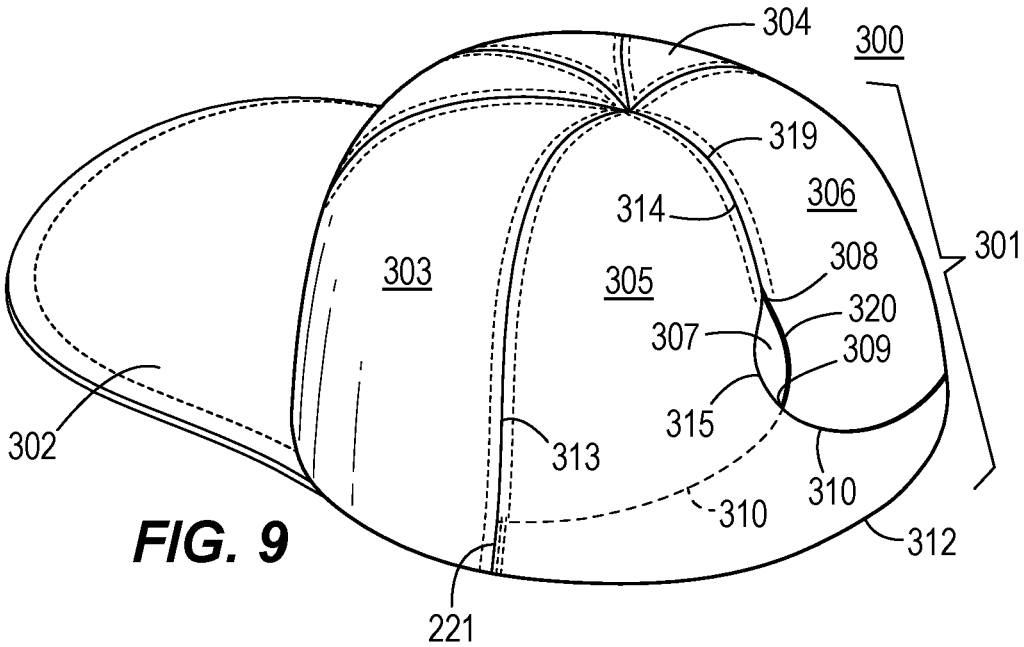
FIG. 9 illustrates a perspective view of a baseball-type hat having a varying circumference aperture.
Figure 10:
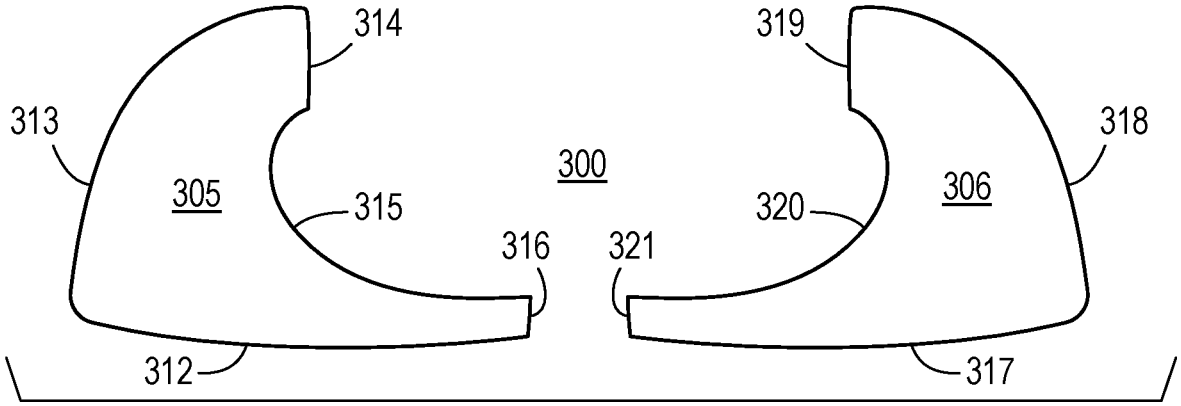
FIG. 10 illustrates the rear panels present in FIG. 9 and FIG. 11.
Figure 11:
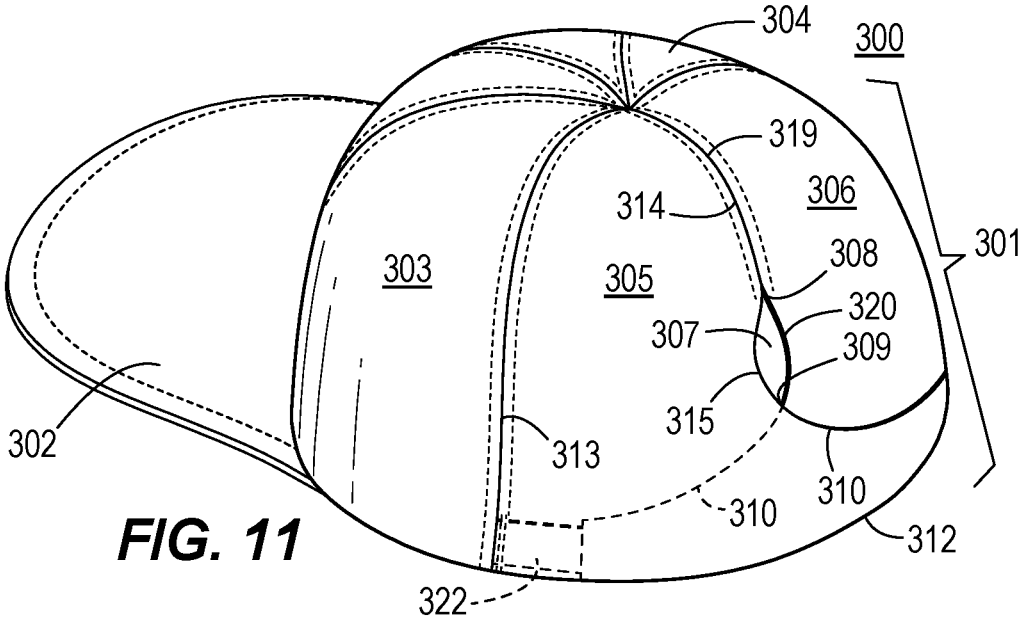
FIG. 11 illustrates a rear view of the hat of FIG. 9 with an alternative configuration.

FIGS. 9-11 illustrate a baseball-type hat 300. Baseball-type hat 300 has similar components to boonie-type hat 100, but includes a different brim configuration. For example, baseball-type hat 300 comprises a body 301 and brim 302 that extends outward from a portion of the body 301. Body 301 includes a plurality of panels; such as: first side panel 304, second side panel 303, first top panel 324, second top panel 325, first rear panel 305, and second rear panel 306.

Referring to FIG. 10, first rear panel 305 can comprise first bottom edge 312, first side edge 313, first top connection edge 314, first arcuate edge 315, and first end edge 316. Second rear panel 306 can comprise second bottom edge 317, second side edge 318, second top connection edge 319, second arcuate edge 320, and second end edge 321. Side edges 313 and 318 can connect to adjacent side panels 303 and 304. Top connection edges 314 and 319 can connect to one another. And end edges 316 and 321 can connect to nonadjacent side panels 303 and 304. When connecting the end edges, first rear panel 305 overlaps second rear panel 306. Because the rear panels interact with one another in a slidable manner, they are able to define an aperture 307 that can be manipulated in size and shape by pulling the panels away from one another. This allows a person to pull panels 305 and 306 in opposite directions to increase a circumference of aperture 307 so that hair may be pulled through. In alternate embodiments (not shown), second rear panel 306 can overlap first rear panel 305. Further, rear panels 305 and 306 can have a plurality of alternative connection edges.

Referring back to FIG. 9, the arcuate edges 315 and 320 (of first rear panel 305 and second rear panel 306) can form a shape defining an aperture 307. Aperture 307 has a top 308 and a bottom 309. Aperture top 308 is defined by the point where first arcuate edge 315 adjoins second arcuate edge 320 and is substantially adjacent top connection edges 314 and 319. Accordingly, aperture top 308 is fixed and cannot move. Aperture bottom 309 is defined by the point where the first arcuate edge 315 (of first rear panel 305) overlaps the second arcuate edge 320 (of second rear panel 306). Because of the overlapping rear panel configuration, aperture bottom 308 is motile.

Referring to FIG. 11, in alternative embodiments, body 301 can further comprise a first elastic connector 311 and second elastic connector 312 (not shown). Elastic connectors 311 and 312 can be used to connect end edges 316 and 321 to their nonadjacent side panels 303 and 304. For example, elastic connector 311 can have a first end that attaches to first panel end edge 316, and a second send that attaches to nonadjacent side panel 304. Elastic connectors 311 and 312 can comprise an elastic material. In this regard, the elastic connector can ensure a more-secure fit to the hat wearer while exerting additional elastic force on aperture 307. In alternative embodiments, elastic connectors 311 and 312 can comprise non-elastic properties. In these embodiments, elastic connectors 311 and 312 can comprise: Velcro, tabs, buttons, or other hat-fitting apparatuses generally known in the art.

IV. Elastic Band

The overlapping, slidable nature of rear panels 105, 106, 205, 206, 305, 306 enables apertures 107, 207, 307 to have multiple circumferences. For example, when no external force is applied to rear panels 105, 106, 205, 206, 305, 306, aperture 107, 207, 307 has a first circumference. If external force is exerted by the wearer to manipulate rear panels 105, 106, 205, 206, 305, 306, a second circumference can be achieved. The second circumference is larger than the first circumference and can enable more hair through aperture 107, 207, 307 than if rear panels 105, 106, 205, 206, 305, 306 did not overlap.

To manipulate rear panels 105, 106, 205, 206, 305, 306 in a manner that allows aperture 107, 207, 307 to achieve a second circumference, arcuate edges 115, 120, 215, 220, 315, 320 can be pulled in opposite directions such that aperture bottom 109, 209, 309 moves relative to aperture top 108, 208, 308. In this manner, the slidable rear panels 105, 106, 205, 206, 305, 306, arcuate edges 115, 120, 215, 220, 315, 320, and aperture bottom 109, 209, 309 determine the shape and circumference of aperture 107, 207, 307.

In many embodiments, elastic band 110, 210, 310 comprises an elastic material and has a non-tensioned length and width. The width can be between 0.05" and 2.0" and the length can be between 3.0" and 34.0" when measured from a first end to a second end. For example, elastic band 110, 210, 310 can have a non-tensioned width of 0.15" and a non-tensioned length of 8.5."

Elastic band 110, 210, 310 can be attached to the periphery of arcuate edges 115, 120, 215, 220, 315, 320 to control the shape and circumference of aperture 107, 207, 307. To control the shape and circumference of aperture 107, 207, 307, elastic band 110, 210, 310 can transition from first arcuate 115, 215, 315 to second arcuate edge 120, 220, 320 in a looping manner such that it overlaps itself at or near aperture bottom 108, 208, 308.

In some embodiments, elastic band 110, 210, 310 spans the entire length of arcuate edges 115, 120, 215, 220, 315, 320. In alternate embodiments (not shown), elastic band 115, 120, 215, 220, 315, 320 can be attached to only a portion of arcuate edges 115, 120, 215, 220, 315, 320. In alternate embodiments (not shown), elastic band 110, 210, 310 can form a concentric loop and/or comprise no ends. In this embodiment, the ends of elastic band 110, 210, 310 can be joined after being attached to a portion of arcuate edges 115, 120, 215, 220, 315, 320. This embodiment can further comprise a cord lock, or other tensioning apparatus which can be attached to elastic band 110, 210, 310 in a manner which allows additional tension to be exerted by elastic band 110, 210, 310.

Elastic band 110, 210, 310 can have elastic properties and exert an elastic force on aperture 107, 207, 307. In this regard, elastic band 110, 210, 310 works to counteract external forces acting to expand aperture 107, 207, 307 beyond a first circumference. For example, if external force is applied to arcuate edges 115, 120, 215, 220, 315, 320, and aperture bottom 109, 209, 309 changes locations such that a second aperture circumference is achieved, then the elastic force exerted by elastic band 110, 210, 310 will work to return aperture bottom 109, 209, 309 to its original location. In this manner, elastic band 110, 210, 310 works to return a second circumference to a first circumference.

When integrated with overlapping and slidable rear panels 105, 106, 205, 206, 305, 306, elastic band 110, 210, 310 permits a wearer to grab rear panels 105, 106, 205, 206, 305, 306, increase the circumference of aperture 107, 207, 307 from a first circumference to a second circumference, and pull her hair through. Once her hair is pulled through and rear panels 105, 106, 205, 206, 305, 306 are released, the elastic band 110, 210, 310 will act to return aperture 107, 207, 307 to a first circumference. Thus, elastic band 110, 210, 310 ensures that aperture 107, 207, 307 closes around the wearer's hair. Further, because the circumference of aperture 107, 207, 307 is determined by the position of aperture bottom 109, 209, 309, and aperture top 108, 208, 308 is fixed, the elastic force exerted by elastic band 110, 210, 310 forces the wearer's hair upwards.

In some embodiments, elastic band 110, 210, 310 is attached to the periphery of rear panel arcuate edges 115, 120, 215, 220, 315, 320 in a manner generally known to those of skill in the art. For example, elastic band 110, 210, 310 can be attached directly, through tunneling, stitching, adhesion, or any other suitable or desired means. In alternate embodiments, elastic band 110, 210, 310 can be placed inside an elongated sleeve (not shown) which is attached to the periphery of rear panel arcuate edges 115, 120, 215, 220, 315, 320. In alternate embodiments, it is contemplated that no elastic band is utilized. In these embodiments, the rear panels 105, 106, 205, 206, 305, 306 are constructed, at least in part, out of an elastic material; such as, spandex, nylon, Lycra, or other materials known in the art.

V. Rear Aperture Shape

The rear panel arcuate edges 115, 120, 215, 220, 315, 320 can have a plurality of different shapes. The different shaped rear panel arcuate edges 115, 120, 215, 220, 315, 320 can define a plurality of different rear aperture 107, 207, 307 shapes. For example, referring to FIGS. 1-5, by altering the shape of arcuate edges 115 and 120, the shape of aperture 107 can be an ellipse, circle, teardrop, triangle, square, rectangle, or any other geometric shape.

In many embodiments, rear apertures 107, 207, 307 can further comprise a plurality of different sizes such that rear apertures 107, 207, 307 can have a first circumference of between 0.25" and 5.0" and a second circumference of between 1.5" and 16.0." For example, rear aperture 107 can have a first circumference of 1.0" and a second circumference of 7.0."

VI. Benefits

The slidable rear panel configuration of hats 100, 200, 300 confers numerous benefits to people with long hair. By defining the rear aperture 107, 207, 307 with slidable rear panels, the aperture 107, 207, 307 can have a variable circumference without a mechanical cinching device (such as buttons, a clasps, or zippers). Operating a mechanical cinching device on the rear of one's head can prove a difficult task as there is no line of sight. Further, a mechanical cinch could catch the wearer's hair in a manner that causes pain or discomfort. Therefore, the slidable rear panel configuration provides an improved method of defining a variably-sized aperture on the rear of a hat.

Further, integrating the overlapping loop configuration of elastic band 110, 210, 310 enables aperture 107, 207, 307 to prop hair upwards. After hair is pulled through aperture 107, 207, 307, the elastic forces provided by elastic band 110, 210, 310 work to contract the circumference of aperture 107, 207, 307. While the elastic forces work to contract aperture 107, 207, 307 from all directions, aperture top 108, 208, 308 is fixed. By fixing the position of aperture top 108, 208, 308, the contracting elastic forces pull aperture bottom 109, 209, 309 upwards towards aperture top 108, 208, 308. This upward force ensures hair will be pulled upwards.

Figure 12A:
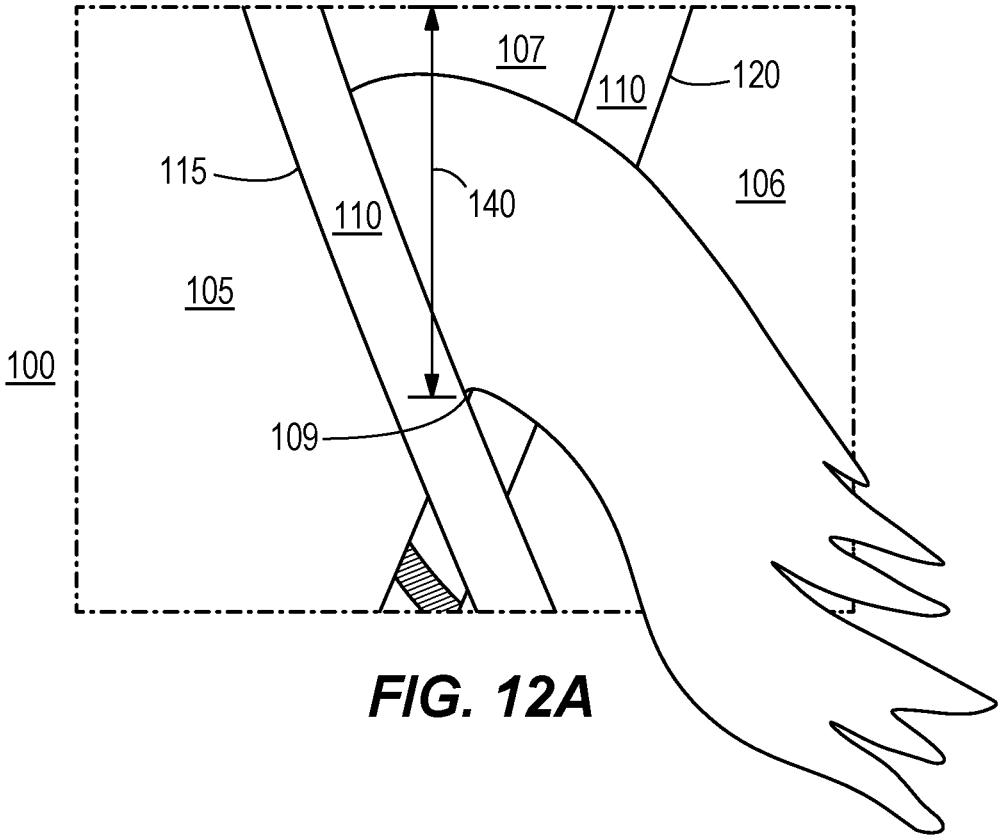
FIG. 12*a* illustrates the hat aperture present in FIG. 1, FIG. 2, and FIG. 3 with hair pulled through the aperture increasing the circumference.
Figure 12B:
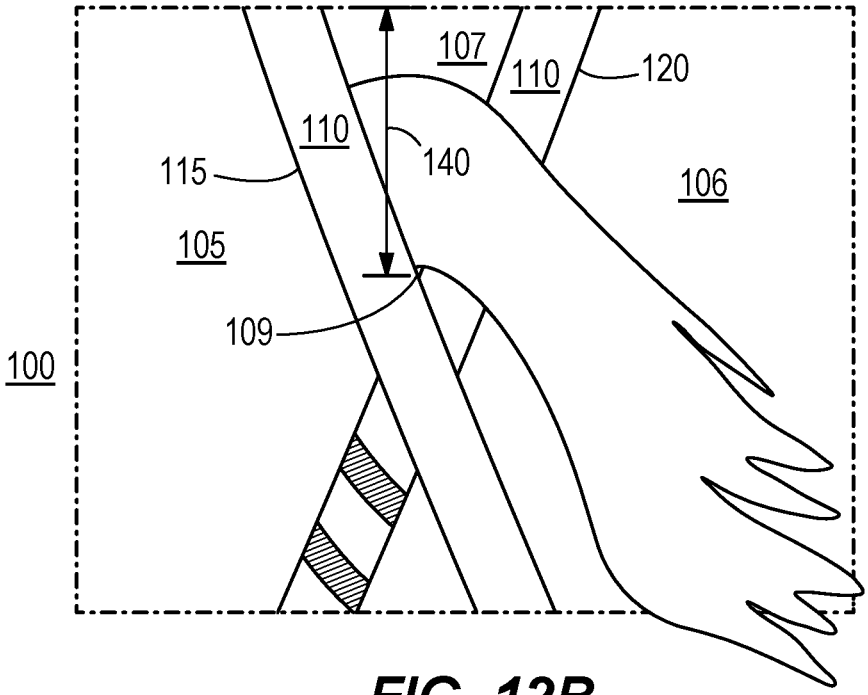
FIG. 12*b* illustrates the hat aperture present in FIG. 1, FIG. 2, and FIG. 3 with hair resting in the aperture and a decreased circumference.

For example, referring to FIG. 12A, external force is applied rear panels 105 and 106 such that arcuate edges 115 and 120 move in opposite directions. As a result, the circumference of aperture 107 is increased and hair can be pulled through. In FIG. 12B, the external force is been released and aperture 107 contracts. The expansion and contraction of aperture 107 is observed by measurement reference 140 which shows that aperture bottom 109 is closer to the top of the hat in FIG. 12B than in FIG. 12A. Because aperture 107 incorporates elastic band 110, the wearer of hat 100 will be able to secure her hair through the back of the hat without any mechanical apparatus. And, because aperture top 108 is fixed, and aperture bottom 109 is motile, the elastic forces exerted by elastic band 110 force aperture bottom 109 upwards. Thus, in addition to providing a more secure fit around the hair, the elastic band 110 acts to prop the hair upwards.

Thus, the slidable rear panel configuration allows the rear aperture to have a variable circumference. The variable circumference permits wearers to pull the rear panels apart, increase the aperture's circumference, and pull hair through. Once the hair is pulled through, and the rear panels are released, the overlapping loop configuration of the elastic band ensures that the rear aperture will contract in a manner that forces the hair upwards.

Securing hair in this manner improves the wearer's protection from the elements in multiple ways. First, by propping the hair upwards, hair will not interfere with the rear of the hat or brim. This helps to prevent the front of the hat from riding upwards on the wearer's head. Further, a boonie-type hat, providing concentric sun protection, may be a more-viable option as the hair will not push the rear brim downward in a manner that forces the front brim upwards. Therefore, propping the hair upwards ensures better sun protection by keeping the front brim in a position to block sunlight from the wearer's face. Second, by propping the wearer's hair upwards, more heat can be dissipated from the wearer's neck area. This can provide increased comfort and work to prevent overheating in hot climates. Third, because aperture 107, 207, 307 contracts around the wearer's hair, less cold air can permeate the hat when worn in cold environments.

Additional benefits include ornamental benefits provided to the wearer. These benefits are conferred because, when wearing the hat, long hair is not draping down in an unsightly manner. And, because of the overlapping panel design, no outside apparatuses, such as zippers, scrunchies, or drawstrings, can be required.

Economic benefits are observed as well. First, the hat is easier and cheaper to manufacture than other solutions due to the lack of mechanical cinching apparatuses. Second, because the hair is supported upwardly upon exiting the hat, logos or other advertisements placed under the aperture will be viewable. For example, in professional golf, golfers generally look away from the camera when swinging. With hat 100, 200, 300, logos placed on the rear of the hat body will be visible to viewers. This increases brand equity and awareness.

What is claimed is:

1. A hat comprising:

a body defining an interior cavity for receiving a head of a wearer when worn;

wherein the body comprises:

a headband, a plurality of panels, and an elastic band;

wherein the plurality of panels define a crown;

wherein the crown comprises:

a front portion, and a rear portion;

wherein the rear portion of the crown comprises a first rear panel and a second rear panel;

wherein the first rear panel comprises a first arcuate edge, a first end edge, and a first top connection edge, and the second rear panel comprises a second arcuate edge, a second end edge, and a second top connection edge;

wherein the first arcuate edge partially overlaps the second arcuate edge;

wherein the first end edge connects to a first nonadjacent side panel and the second end edge connects to a second nonadjacent side panel;

wherein the first top connection edge is permanently fixed to the second top connection edge;

wherein the overlapping arcuate edges form a shape defining an aperture;

wherein the shape comprises a top and a bottom;

wherein the top of the shape is fixed in place;

wherein the bottom of the shape is motile;

wherein a circumference of the shape can be increased by manipulating the bottom of the aperture;

wherein the elastic band comprises:

a first portion coupled to a periphery of the first arcuate edge, and a second portion coupled to a periphery of the second arcuate edge;

wherein the elastic band transitions from the first arcuate edge to the second arcuate edge in an overlapping manner such that it forms a loop; and wherein the elastic band exerts an elastic force when a circumference of the aperture is increased.

2. The hat of claim 1, wherein the hat is a piece of headgear selected from a group consisting of: boonie-type hats, baseball-type hats, and beanie-type hats.

3. The hat of claim 1, wherein the aperture comprises a height and a width; and the height of the aperture is greater than the width.

4. The hat of claim 1, wherein the aperture comprises a height and a width; and the height of the aperture is not greater than the width.

5. The hat of claim 1, wherein the first rear panel comprises an elastic material.

6. The hat of claim 1, wherein the second rear panel comprises an elastic material.

7. The hat of claim 1, wherein the elastic band is attached directly to the first arcuate edge and second arcuate edge.

8. The hat of claim 1, wherein the elastic band overlaps itself at the bottom of the aperture.

9. The hat of claim 1, wherein the elastic band extends in a continuous manner around the body of the hat.

10. A hat comprising:

a domed crown defining an interior cavity for receiving a head of a wearer when worn;

wherein the domed crown comprises:

a front portion, a rear portion, a headband, and an elastic band;

wherein the rear portion of the domed crown comprises a first rear panel and a second rear panel;

wherein the first rear panel comprises a first arcuate edge, a first end edge, and a first top connection edge, and the second rear panel comprises a second arcuate edge, a second end edge, and a second top connection edge;

wherein the first arcuate edge partially overlaps the second arcuate edge;

wherein the first top connection edge is permanently fixed to the second top connection edge;

wherein the first rear panel and second rear panel each comprise an elastic connector;

wherein the elastic connectors connect the first end edge of the first rear panel to a first nonadjacent side panel, and the second end edge of the second rear panel to a second nonadjacent side panel;

wherein the overlapping arcuate edges form a shape defining an aperture;

wherein the shape comprises a top and a bottom;

wherein the top of the shape is fixed in place;

wherein the bottom of the shape is motile;

wherein a circumference of the shape can be increased by manipulating the bottom of the aperture;

wherein the elastic band comprises:

a first portion coupled to a periphery of the first arcuate edge, and a second portion coupled to a periphery of the second arcuate edge;

wherein the elastic band transitions from the first arcuate edge to the second arcuate edge in an overlapping manner such that it forms a loop; and wherein the elastic band exerts an elastic force when a circumference of the aperture is increased.

11. The hat of claim 10, wherein the hat is a piece of headgear selected from a group consisting of: boonie-type hats, baseball-type hats, and beanie-type hats.

12. The hat of claim 10, wherein the aperture comprises a height and a width; and the height of the aperture is greater than the width.

13. The hat of claim 10, wherein the aperture comprises a height and a width; and the height of the aperture is not greater than the width.

14. The hat of claim 10, wherein the first rear panel comprises an elastic material.

15. The hat of claim 10, wherein the second rear panel comprises an elastic material.

16. The hat of claim 10, wherein the elastic band is attached directly to the first arcuate edge and second arcuate edge.

17. The hat of claim 10, wherein the elastic band overlaps itself at the bottom of the aperture.

18. The hat of claim 10, wherein the elastic band extends in a continuous manner around a body of the hat.

* * * * *